US006389716B1

(12) United States Patent
Riebeling et al.

(10) Patent No.: US 6,389,716 B1
(45) Date of Patent: May 21, 2002

(54) SHIRT SLEEVE PRESSING MACHINE

(75) Inventors: Linda A. Riebeling, Tunkannock; Carol J. Ferrell, Dushore, both of PA (US)

(73) Assignee: Hoffman/New Yorker, Inc., Bloomfield, NJ (US)

( * ) Notice: Subject to any disclaimer, the term of this patent is extended or adjusted under 35 U.S.C. 154(b) by 0 days.

(21) Appl. No.: 09/825,263

(22) Filed: Apr. 3, 2001

(51) Int. Cl.[7] ..... D06F 71/28
(52) U.S. Cl. ..... 38/12; 223/73
(58) Field of Search ..... 38/12, 13, 14, 38/7; 223/521, 72, 73, 74, 68

(56) References Cited

U.S. PATENT DOCUMENTS

| | | | | |
|---|---|---|---|---|
| 2,715,986 A | * | 8/1955 | Ebner | |
| 2,969,897 A | * | 1/1961 | Paris | |
| 3,080,667 A | | 3/1963 | Neckel et al. | |
| 3,568,900 A | | 3/1971 | Paris | |
| 4,607,589 A | * | 8/1986 | Gibson | 38/14 X |
| 5,474,216 A | | 12/1995 | Harrod et al. | |
| 5,758,437 A | | 6/1998 | Tamamoto | |

OTHER PUBLICATIONS

Brochure on Hoffman/New Yorker Model CSL Sleever Machine.
Hoffman/New Yorker Manually Operated Cuff Clamp Assembly Dwg. 74111.
Hoffman/New Yorker Cuff Clamp Link Assmebly Dwg. 74112 which is part of Cuff Clamp Assembly Dwg. 74111.

* cited by examiner

*Primary Examiner*—Ismael Izaguirre
(74) *Attorney, Agent, or Firm*—David A. Tamburro

(57) ABSTRACT

Apparatus for pressing the sleeves of a shirt comprises a pair of laterally spaced upright bucks over which the sleeves may be placed and pneumatically operated clamps mounted on the upper end of each of the bucks for holding the cuffs of the sleeves during a pressing operation. Each clamp includes a head or block having a vertical clamping surface, a pneumatic cylinder mounted within the block having its piston rod extending generally perpendicularly outwardly through the surface, and a T-clamp connected to the rod for movement toward and away from the surface upon actuation of the cylinder. A pneumatic control circuit controls operation of the cylinders. A hold down device located between the bucks applies tension to the sleeves of a shirt during a pressing operation.

17 Claims, 4 Drawing Sheets

SHIRT SLEEVE PRESSING MACHINE

BACKGROUND OF THE INVENTION

This invention relates generally to shirt sleeve pressing machines and more particularly to a shirt sleeve pressing machine which includes a novel pneumatically operated cuff-clamping device.

Machines for pressing the sleeves of a shirt are commercially available such as the cabinet style bag sleever Model CSL which has been manufactured and sold by the assignee of this invention, Hoffman/New Yorker, Inc. Those machines generally include a pair of laterally spaced vertically extending sleeve bucks on which are mounted inflatable air bags. At the upper end of each of the bucks is a manually operated T-clamp for holding the cuffs of the shirt in place during a pressing operation. To press the sleeves, at an accessible loading station, an operator passes the shoulders of the shirt over the cuff clamps and the shirt is fully extended downwardly with the sleeves over the bucks. The cuffs of the shirt are positioned under the open T-clamps and the clamps are then manually closed to lock the cuffs in place. Low pressure is then supplied to the air bags to remove wrinkles from the sleeves and to tension the sleeves. The bucks are then moved from the loading station to a pressing station within a pressing cabinet and moveable pressing arms and steam are then applied against the sleeves and buck for a predetermined period of time under the control of a timer. Upon completion of the timed cycle, the bucks are returned from the pressing cabinet to the loading station and, upon movement out of the cabinet, the clamps are automatically opened thereby releasing the cuffs. The sleeves and the shirt are then removed upwardly from the bucks. This is the manner in which the Model CSL machine is operated.

While the CSL machine has enjoyed substantial commercial success, applicants have recognized the need to improve the construction and operation of the cuff clamping devices and the invention as described below was developed to satisfy that need.

SUMMARY OF THE INVENTION

The primary object of this invention is to provide a novel shirt sleeve pressing machine in which the cuff clamping devices at the top of the sleeve bucks are pneumatically operated, preferably by foot operated valves, to open and close the clamps while loading and unloading the shirt cuffs. Such an operation has been found to be much more efficient and time saving as opposed to the manually operated clamp design which has been commonly used in prior commercial machines.

Another object of this invention is to provide the above described novel shirt sleeve pressing machine in which the pneumatically operated cuff clamping devices include a clamp head or block, a small pneumatic cylinder mounted within the block and having a reciprocating piston extending perpendicularly outwardly from an inside vertical clamp face of said block and connected to a T-clamp for reciprocating the clamp in straight line motion toward and away from the inside face of the block. The piston is spring loaded to maintain the T-clamp in a normally open position and the application of air pressure to the cylinder closes the T-clamp to hold the cuffs of the shirts in place against the clamp face of the block.

Still another object of the invention is to provide the novel shirt sleeve pressing machine described above in which the pneumatically operated cuff clamp assemblies are actuated by foot operated valves mounted at the floor of the machine so as to free the hands of the operator and enable the operator to properly position the shirt and cuffs on the bucks and to press other operating buttons on the machine thereby saving time and rendering the overall operation more efficient.

A further object of the invention is to provide the above novel shirt sleeve pressing machine with a shirt hold down device positioned between the two laterally spaced bucks and operable to push down on the collar area of the shirt and thereby further tension the sleeves during the pressing operation.

Still another object of the invention is to provide a novel buck and cuff clamp assembly including associated pneumatic control components which may be quickly and easily retrofitted to existing commercial machines containing manually operated cuff clamp assemblies.

These and other objects and advantages of the invention will become more apparent from reading the following detailed description of the invention in which reference is made to the accompanying drawings, wherein like numerals indicate like elements.

DETAILED DESCRIPTION OF THE INVENTION

Figure 2:
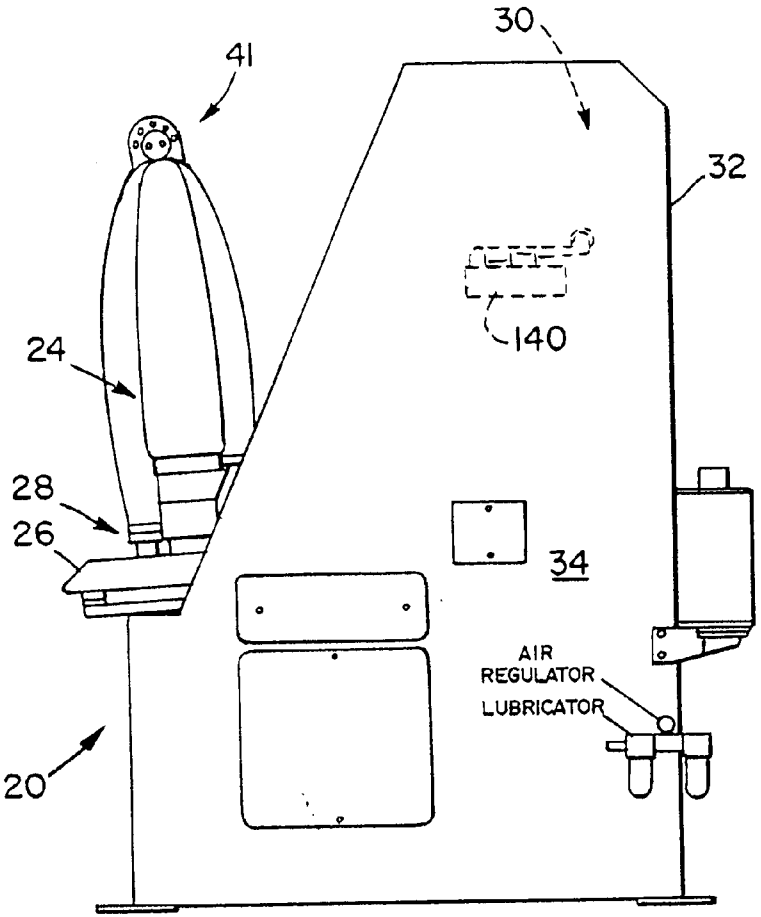
FIG. 2 is a side elevational view of the machine taken along line 2—2 of FIG. 1.
Figure 1:
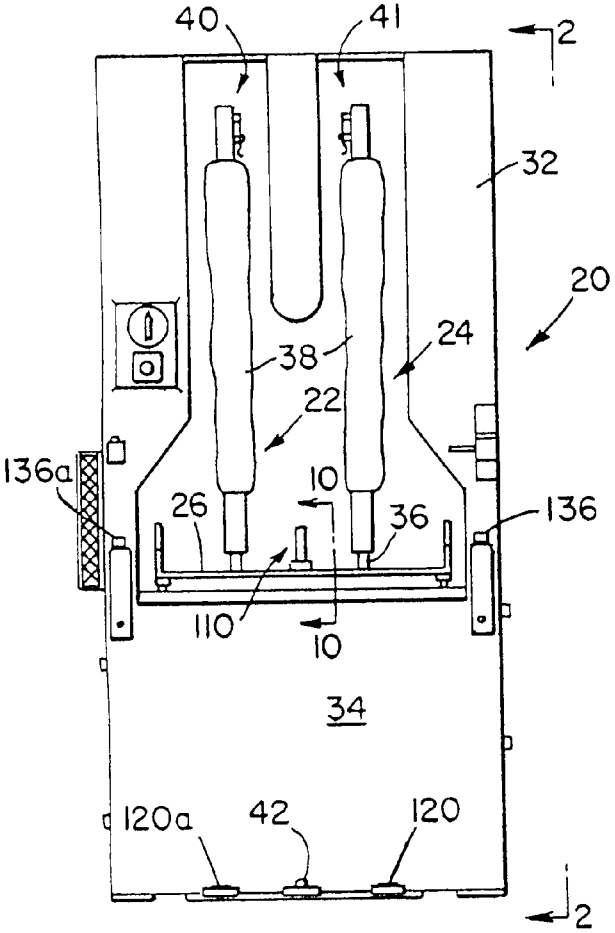
FIG. 1 is a front elevational view of the shirt sleeve pressing machine of the invention.

Referring now to FIGS. 1 and 2, the shirt sleeve pressing machine 20 of the invention includes a pair of laterally spaced sleeve pressing buck assemblies 22 and 24 mounted at their lower ends on a pan 26 which is slideable between a forward operator accessible loading station 28 and a rearward pressing station 30 within the upper portion 32 of cabinet 34. Each buck assembly 22 and 24 includes an upright buck plate 36 connected at its lower end to pan 26 and an air inflatable bag 38 surrounding plate 36, with pneumatically operated cuff clamp assemblies 40 and 41 fixed to the upper end of each plate of bucks 22 and 24.

Figure 9:
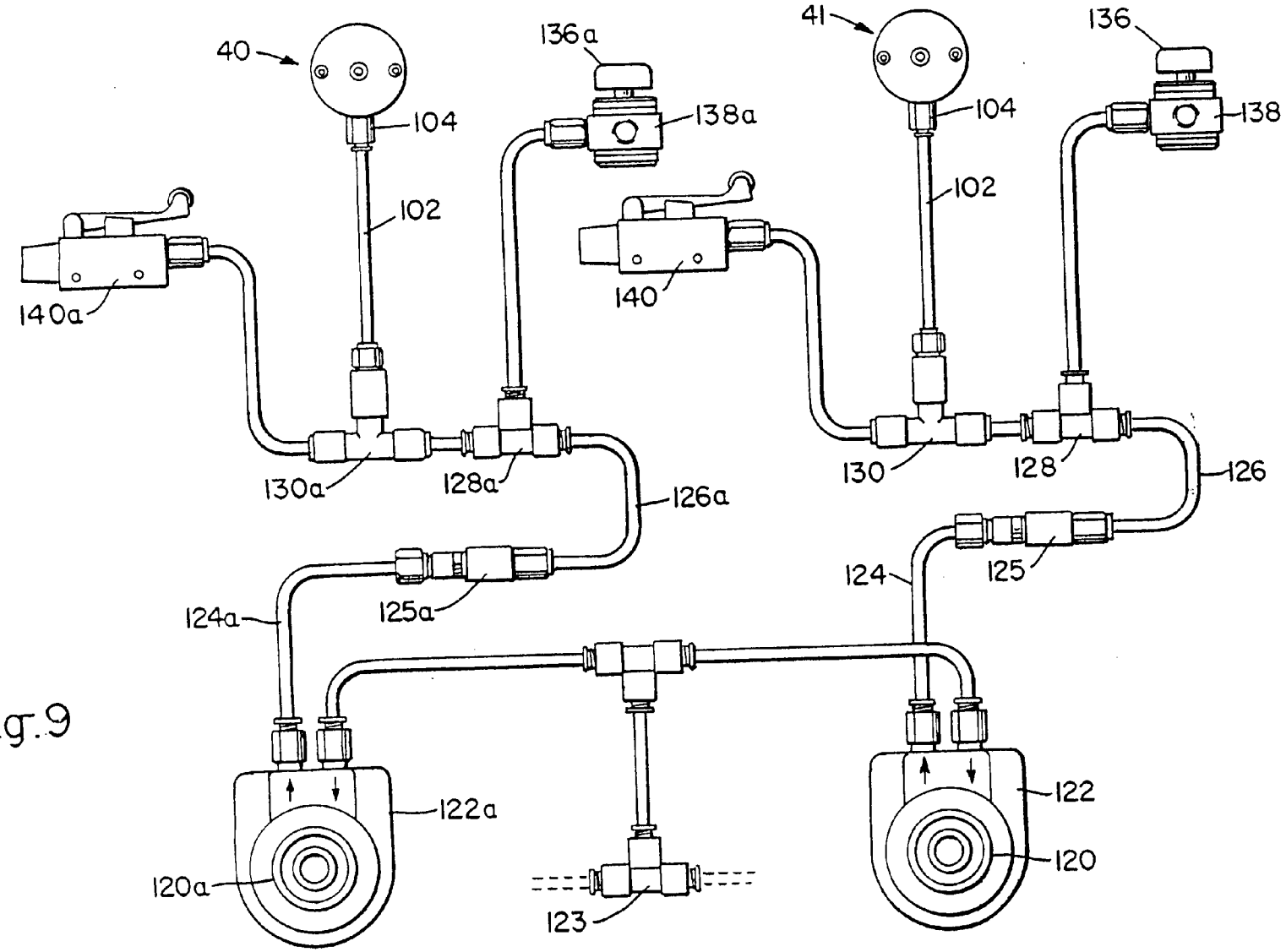
FIG. 9 is a schematic illustration of the pneumatic control circuitry by which the cuff clamp assemblies are operated.

Except for the air operated clamp assemblies 40 and 41 and their associated pneumatic control circuitry illustrated in FIG. 9, the construction of buck assemblies 22 and 24, cabinet 34, and the electrical, air, and steam supplies to machine 20 are essentially the same as those employed in Hoffman/New Yorkers previous Model CSL sleeve pressing machine mentioned above. Those systems are generally known in the industry and will not be described in any detail herein.

Generally speaking, to press the sleeves of a shirt the buck assemblies 22 and 24 are first located at the accessible loading station 28 and, with the back of the shirt facing the operator, the shoulders of the shirt are passed over the cuff clamp assemblies 40 and 41 and the collar of the shirt is pressed downwardly so that the left sleeve of the shirt fully extends downwardly on buck 22 and the right sleeve of the shirt fully extends downwardly on buck 24. The cuffs of the shirt are positioned within the clamp assemblies 40 and 41 and low pressure air is supplied to air bags 38 by depressing a center foot pedal 42. The bucks 22 and 24 are then moved rearwardly from station 28 to the pressing station 30 within the upper cabinet section 32 where suitable mechanical pressing arms and steam are applied against the shirt sleeves for a predetermined period of time to press the sleeves. At the end of the pressing cycle the bucks are then moved outwardly back to the station 28, the clamp assemblies 40 and 41 are opened and the sleeves of the shirt are removed from the buck assemblies 22 and 24. This is the same general operation as in the Model CSL machine.

As mentioned hereinabove, the invention of this application lies in the construction and operation of the pneumatically operated cuff clamping devices 40 and the pneumatic circuitry by which they are controlled.

As illustrated in FIGS. 3 through 8, each pneumatically operated cuff clamp assemblies 40 and 41 include a generally rectangular head or block 42, preferably of stainless steel, connected to the upper end of buck plate 36 by suitable cap screws extending through holes 44 and 46 drilled through the lower portion of vertical front face 48 of block 42 and nuts that fit within slots 50 and 52 milled into block 42 from rear face 54 which is parallel to front face 48. A cylindrical bore 56 extends from rear face 54 into block 42 to a base wall 58 and hole 60 is drilled from face 48 through wall 58. Bore 56 and hole 60 are perpendicular to faces 48 and 54. A smaller diameter hole 62 is drilled through block 42 between faces 48 and 54 on the same vertical centerline as bore 56 and hole 60 and parallel thereto. A large counterbore 64 extends inwardly from face 54 a short distance and encircles hole 62 and bore 56. A pair of drilled and tapped holes 66 extend from the base of counterbore 64 into block 42. A plurality of drilled holes 70 extend between faces 48 and 54 across the top of block 42. A vertical hole 72 extends downwardly through the bottom of block 42 from bore 58 through the bottom face 74 of the block.

Figure 4:
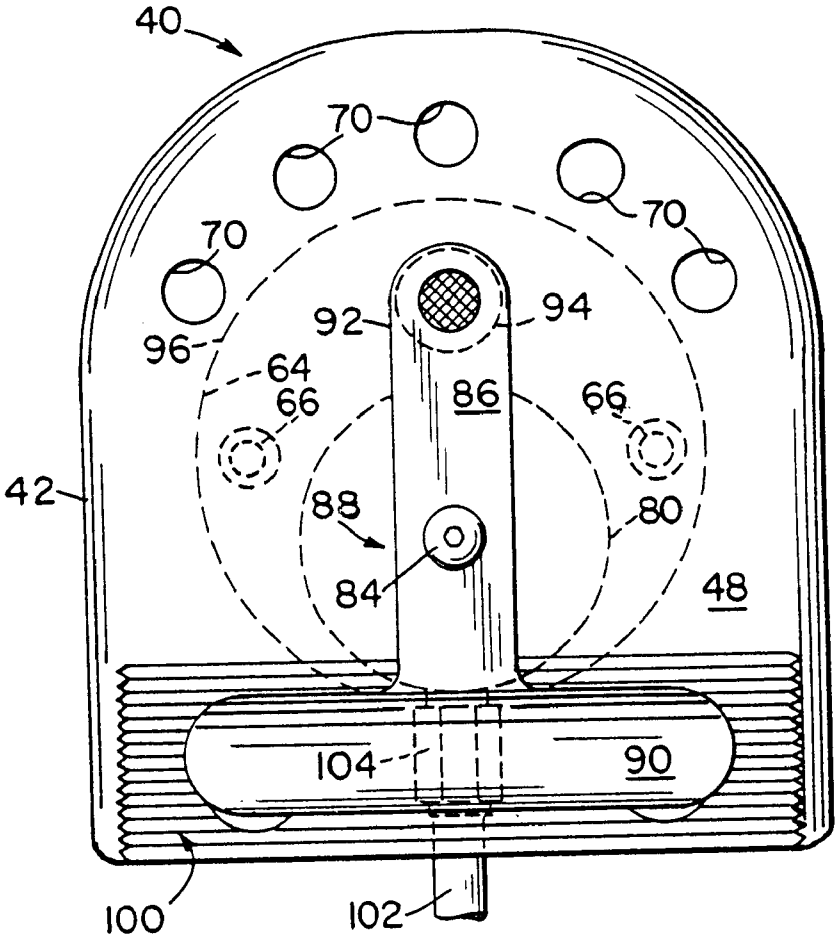
FIG. 4 is a side elevational view of the cuff clamp assembly taken along line 4—4 of FIG. 3.
Figure 3:
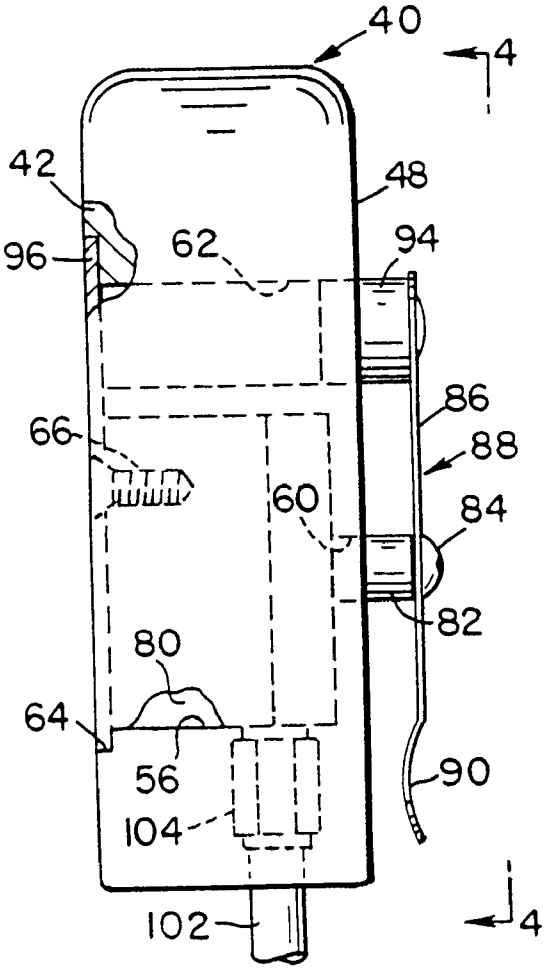
FIG. 3 is an enlarged front elevational view of the novel pneumatically operated cuff clamp assembly of the invention, shown in substantially full scale.
Figure 6:
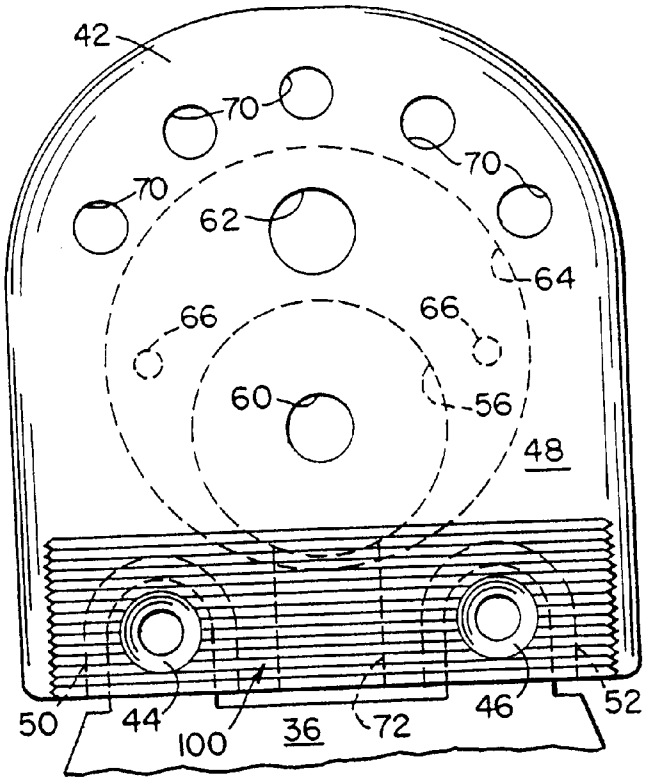
FIG. 6 is a side elevational view of the block taken along line 6—6 of FIG. 5.
Figure 5:
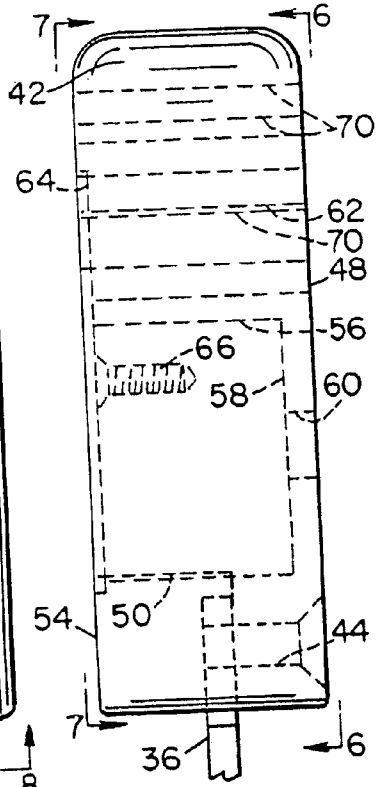
FIG. 5 is a front elevational view of the cuff clamp block which is part of the assembly illustrated in FIG. 3, shown in substantially full scale.
Figure 7:
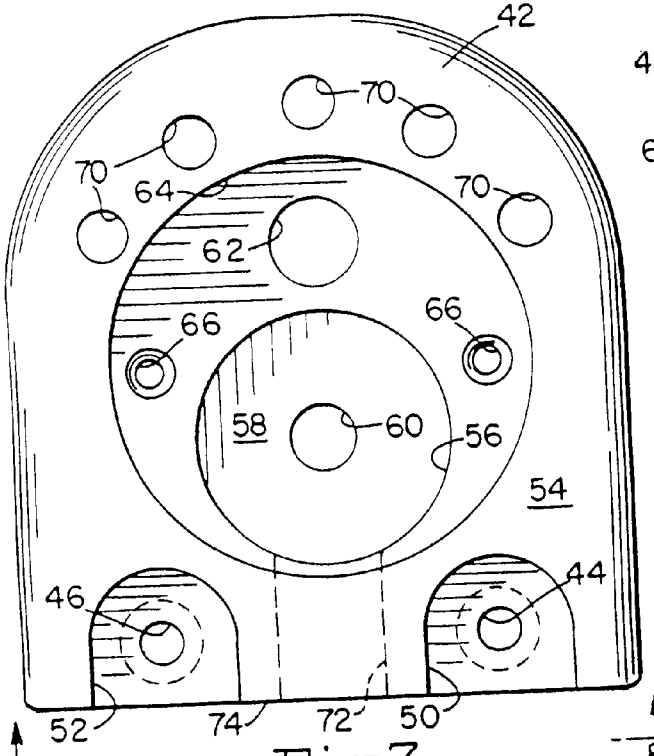
FIG. 7 is an elevational view of the opposite side of the cuff clamp block taken along line 7—7 of FIG. 5.
Figure 8:
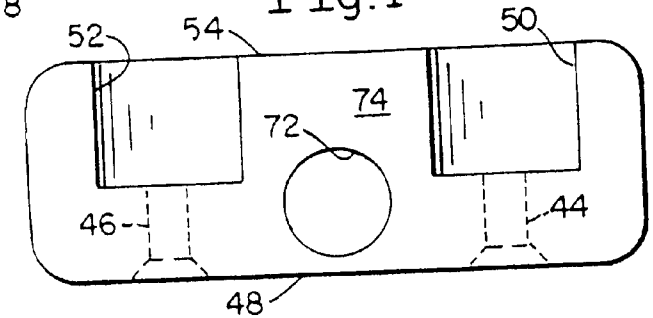
FIG. 8 is a bottom view of the block taken along line 8—8 of FIG. 7.

As shown in FIGS. 3 and 4, a small cylindrical air cylinder 80 is mounted within bore 56 and has a piston rod 82 extending outwardly through opening 60, the outer end of which is connected by way of screw 84 to the vertical leg 86 of an inverted T-clamp 88, the concave horizontal leg 90 of which acts as a clamp face upon actuation of cylinder 80. The upper end 92 of leg 86 is connected to a guide pin 94 which is slideably mounted within opening 62. Piston rod 82 and pin 94 move parallel to each other so that T-clamp 88 reciprocates in straight line motion toward and away from face 48 of block 42. A circular cover plate 96 is fixed within counterbore 64 and is held in place through suitable cap screws which thread into openings 66. Plate 96 retains the small cylinder in place within bore 56 and covers the back end of opening 62.

Air cylinder 80 is a commercially available cylinder manufactured by Springville Mfg. Co., Inc. of Springville, New York as Part Number CSE ¾ by ¼ V. The cylinder is 1½ inches diameter by 1³⁄₃₂ inches wide, has ¼" stroke, and is spring loaded to push the piston rod 82 outwardly to normally retain the T-clamp 86 in an open position with horizontal leg 90 spaced away from the knurled portion 100 on face 48. When air is supplied to cylinder 80 via tubing 102, which extends downwardly through the buck assembly, and fitting 104 piston rod 82 moves inwardly to pull T-clamp 88 toward face 48 and thereby press leg 90 against the knurled portion 100 of block 42. Pin 94 reciprocates inwardly with rod 82 to maintain proper alignment of T-clamp 88 as it is reciprocated back and forth with respect to face 48.

During operation, as machine 20 is used to press a number of shirt sleeves the temperature of block 42 can rise to about 300° Fahrenheit and the through openings 70 at the top of the block promote circulation of air through the block to cool the block.

As shown in FIG. 1 the cuff clamp assembly 40 of the left side buck assembly 22 and clamp assembly 41 of the right side buck assembly 24 are mounted on the plates 36 such that the inside face 48 and T-clamp 88 of each assembly faces inwardly so as to be mirror images of each other. In this way, the open portion of the cuff of each of the left and right sleeves of the shirt may be positioned and clamped between the horizontal legs 90 of T-clamp 88 and the knurled section 100 of block face 48.

Operation of the cuff clamp assemblies 40 and 41 will now be described as part of an overall shirt sleeve pressing operation, the cuff clamp assemblies being controlled by the pneumatic circuitry illustrated in FIG. 9. With the buck assemblies 22 and 24 positioned at the operator accessible loading station 28, a shirt is grasped so that the back of the shirt faces the operator and the shoulders of the shirt are passed over the cuff clamp assemblies 40 and 41, the left sleeve being pulled downwardly on buck assembly 22 and the right sleeve being pulled downwardly on buck assembly 24. The shirt and collar portion are pushed to the bottom of the buck assemblies to fully extend the sleeves. The cuffs of the shirt are then placed around the block 42 with the open portions of the cuffs being positioned between the block face 48 and T-clamps 88. The right sleeve cuff is locked in place in cuff clamp assembly 41 by depressing a right foot pedal 120 of a foot operated valve 122, at the floor of the machine, which supplies air from an air source 123 to line 124 through check valve 125, line 126, tee 128 into another tee 130 to line 102 and fitting 104, feeding air to the cylinder 80 of cuff clamp assembly 41. This actuates the cylinder to pull T-clamp 88 inwardly to thereby clamp the cuff of the sleeve between horizontal leg 90 and knurled section 100. Similarly, to lock the cuff of the left sleeve in place in clamp assembly 40, the left foot pedal **120*a* of foot operated valve 122*a* is depressed to supply air to line 124*a* through check valve 125*a*, line 126*a*, tee 128*a*, and tee 130*a* to line 102 and fitting 104, thereby supplying air to cylinder 80 of left clamp assembly 40 and causing the T-clamp assembly 88 to lock the cuff of the left sleeve in place between leg 90 and knurl section 100**.

If the cuff being clamped by clamp assembly 41 requires repositioning, the operator need only manually depress button 136 of a hand operated pressure relief valve 138, mounted on the frame adjacent pan 26, to open the cylinder 80 and T-clamp 88 of clamp assembly 41. After the operator repositions the cuff of the sleeve, foot pedal 120 is again depressed to actuate the cylinder and lock the cuff within clamp assembly 41. Repositioning of the cuff on the left side clamp assembly 40 may be accomplished by similarly depressing the hand button 136*a* of relief valve 138*a* to open assembly 40 and then subsequently depressing foot pedal 120*a* to again close clamp assembly 40.

The operator then applies slight downward hand pressure against the yoke or collar portion of the shirt to smooth out any wrinkles in the sleeves. At the same time the center foot pedal 42 is depressed to supply low air pressure to air bags 38 to further stretch and dewrinkle the sleeves.

Figure 10:
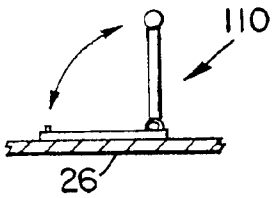
FIG. 10 is a fragmentary view of the hold down device taken generally along line 10—10 FIG. 1.

To further tension the sleeves a hold down device 110 is mounted on pan 26 between buck assemblies 22 and 24 and is moveable between an open position (FIG. 10) and a closed position overlying the collar portion of the shirt and pulling down on the sleeves.

With the sleeves of the shirt thus positioned on buck assemblies 22 and 24, the bucks are moved rearwardly to the pressing station 30 within cabinet section 32 and the sleeves of the shirt are then pressed by the moveable pressing arms and steam in the same way as in the commercial Model CSL machine. When the pressing operation is complete, the pressing arms move away from bucks 22 and 24 and the bucks are moved out of cabinet section 32 back to the loading station 28. As the pressing arms move away from the bucks, they actuate roller operated relief valves 140 and 140a, mounted within the cabinet, to relieve the air pressure from cylinders 80 and thereby open the cuff clamp assemblies 40 and 41. At station 28 the operator then removes the cuffs from the clamp assemblies, releases the hold down assembly 110, and removes the shirt sleeves upwardly from bucks 22 and 24.

From the description hereinabove, it is apparent that the pneumatic cuff clamp assemblies 40 and 41 of the invention satisfy the objects and provide the advantages set forth hereinabove. They enable an operator to use his hands to perform other functions, thus saving time and increasing efficiency of the overall pressing operation. The cuff clamp assemblies are of simple construction and include a minimum of parts. The design of the clamp block 42 enables the small air cylinder to be mounted therein to provide straight reciprocating movement of the T-clamp with respect to the clamp face on the block. The drilled holes 70 through the block provide cooling for the block to help maintain reliable continued operation of the cylinders 40 and 41 and the T-clamp assemblies during repeated pressing operations. And the simple pneumatic control circuitry of FIG. 9 provides efficient, time saving operation of the cuff clamp assemblies during repeated shirt sleeve pressing operation.

The reliability and simplicity of the cuff clamp assemblies and its control circuitry enable the system to be readily retrofitted to machines such as the Model CSL machine containing manually operated cuff clamps.

The foregoing relates to preferred exemplary embodiments of the invention, it being understood that other variants and embodiments thereof are possible within the spirit and scope of the invention, the latter being defined by the appended claims.

What is claimed is:

1. Apparatus for pressing the sleeves of a shirt comprising a pair of laterally spaced upright bucks over which the sleeves may be placed, clamp means mounted on the upper end of each of said bucks, each clamp means including a block having a vertical clamping surface, a pneumatic cylinder mounted within said block and having a rod extending outwardly beyond said surface, a clamp element connected to said rod for movement toward and away from said surface upon actuation of said cylinder, said clamp means comprising means for guiding said clamp element for reciprocating movement toward and away from said surface, said guiding means comprises a pin connected to said clamp element and slidable in said block along an axis which is generally parallel to the axis of said rod, and pneumatic control means for actuating said cylinders between clamping and unclamping positions.

2. The apparatus of claim 1, comprising means for cooling said block.

3. The apparatus of claim 2, said cooling means comprising a plurality of holes in said block.

4. Apparatus for pressing the sleeves of a shirt comprising a pair of laterally spaced upright bucks over which the sleeves may be placed, clamp means mounted on the upper end of each of said bucks, each clamp means including a block having a vertical clamping surface, a pneumatic cylinder mounted within said block and having a rod extending outwardly beyond said surface, a clamp element connected to said rod for movement toward and away from said surface upon actuation of said cylinder, and pneumatic control means for actuating said cylinders between clamping and unclamping positions, said pneumatic control means comprising foot operated valve means for supplying air to said cylinders.

5. The apparatus of claim 4, said control means further including hand operated valve mans enabling an operator to deactivate said cylinders and thereby release the cuffs from said clamp means.

6. The apparatus of claim 4, wherein said bucks are movable between a shirt loading station and a shirt pressing station, and relief valve means automatically actuatable upon completion of a pressing operation as said bucks move from said pressing station back to said loading station to deactivate said air cylinders to open said clamp elements.

7. The apparatus of claim 6, said control means further including hand operated reset valve means enabling an operator to deactivate said cylinders if necessary to reposition the cuffs of the sleeve at the loading station.

8. Apparatus for pressing the sleeves of a shirt comprising a pair of laterally spaced upright bucks over which the sleeves may be placed, clamp means mounted on the upper end of each of said bucks, each clamp means including a block having a vertical clamping surface, a bore within said block extending generally perpendicular to said surface, a pneumatic cylinder mounted within said bore and having a rod extending outwardly beyond said surface, a clamp element connected to said rod for movement toward and away from said surface upon actuation of said cylinder, and pneumatic control means for actuating said cylinders between clamping and unclamping positions.

9. The apparatus of claim 8, said pneumatic control means comprising foot operated valve means for supplying air to said cylinders.

10. The apparatus of claims 9, said control means further including hand operated valve means enabling an operator to deactivate said cylinders and thereby release the cuffs from said clamp means.

11. The apparatus of claim 8, wherein said bucks are moveable between a shirt loading station and a shirt pressing station, said pneumatic control means comprising a foot operated valve means for supplying air to said cylinders to thereby cause said clamp elements to clamp the cuffs of the sleeves against said surfaces, and relief valve means automatically actuatable upon completion of a pressing operation as said bucks move from said pressing station back to said loading station to deactuate said air cylinders to move said clamp elements back to an unclamping position.

12. The apparatus of claim 11, said control means further including hand operated reset valve means enabling an operator to deactivate said cylinders if necessary to reposition the cuffs of the sleeve at the loading station.

13. The apparatus of claim 8, said clamp means comprising means for guiding said clamp element for reciprocating movement toward and away from said surface including a pin connected to said clamp element and slidable in said block along an axis which is generally parallel to the axis of said rod.

14. The apparatus of claim 13, comprising a plurality of holes in said block for cooling said block.

15. Apparatus for pressing the sleeves of the shirt comprising a pair of laterally spaced upright bucks over which the sleeves may be placed, clamp means mounted on the upper end of each of said bucks, each clamp means including a head having a vertical clamping surface and a clamp element connected to said block for movement relative to said surface to clamp the cuffs of a sleeve against said surface, and hold down means located between said bucks and operable to apply a downward force against the collar area of a shirt to thereby tension the sleeves during a pressing operation.

16. Apparatus for pressing the sleeves of a shirt comprising a pair of laterally spaced upright bucks over which the sleeves may be placed, clamp means mounted on the upper end of each of said bucks, each clamp means including a block having a vertical clamping surface, a pneumatic cylinder mounted within said block and having a rod extending outwardly beyond said surface, a clamp element connected to said rod for movement toward and away from said surface upon actuation of said cylinder, pneumatic control means for actuating said cylinders between clamping and unclamping positions, and means for cooling said block comprising a plurality of holes in said block.

17. Apparatus for pressing the sleeves of a shirt comprising a pair of laterally spaced upright bucks over which the sleeves may be placed, clamp means mounted on the upper end of each of said bucks, each clamp means including a block having a vertical clamping surface, a pneumatic cylinder mounted within said block and having a rod extending outwardly beyond said surface, a clamp element connected to said rod for movement toward and away from said surface upon actuation of said cylinder, pneumatic control means for actuating said cylinders between clamping and unclamping positions, and hold down means located between said bucks and operable to apply a downward force against the collar area of a shirt to thereby tension the sleeves during a pressing operation.

* * * * *